US007101118B2

(12) United States Patent
Brinkel et al.

(10) Patent No.: US 7,101,118 B2
(45) Date of Patent: Sep. 5, 2006

(54) MULTI HULL BARGE

(75) Inventors: Theodorus Johannes Bernardus Brinkel, Rijswijk (NL); Willem Cornelis Van Wijngaarden, Gorinchem (NL)

(73) Assignee: IHC Gusto Engineering B.V., Schiedam (NL)

( * ) Notice: Subject to any disclaimer, the term of this patent is extended or adjusted under 35 U.S.C. 154(b) by 0 days.

(21) Appl. No.: 10/502,579

(22) PCT Filed: Feb. 3, 2003

(86) PCT No.: PCT/NL03/00073

§ 371 (c)(1),
(2), (4) Date: Feb. 17, 2005

(87) PCT Pub. No.: WO03/064245

PCT Pub. Date: Aug. 7, 2003

(65) Prior Publication Data

US 2005/0141968 A1 Jun. 30, 2005

(30) Foreign Application Priority Data

Feb. 1, 2002 (EP) ..... 02075405

(51) Int. Cl.
*E02D 27/38* (2006.01)
*E02B 17/08* (2006.01)
*F16L 1/12* (2006.01)

(52) U.S. Cl. ..... 405/203; 405/169; 405/195.1; 405/210; 114/264; 114/267

(58) Field of Classification Search ..... 405/195.1, 405/203–205, 210, 169; 114/74 A, 74 R, 114/264, 266, 267
See application file for complete search history.

(56) References Cited

U.S. PATENT DOCUMENTS

| | | | | |
|---|---|---|---|---|
| 3,217,681 | A * | 11/1965 | Thornton et al. | 114/265 |
| 3,774,562 | A * | 11/1973 | Dean, III | 114/293 |
| 3,943,872 | A | 3/1976 | de Does | |
| RE29,167 | E * | 4/1977 | Lloyd, III | 114/264 |
| 4,232,625 | A * | 11/1980 | Goren et al. | 114/264 |
| 4,446,807 | A * | 5/1984 | Johnson et al. | 114/230.23 |
| 4,646,672 | A * | 3/1987 | Bennett et al. | 114/264 |
| 4,841,895 | A * | 6/1989 | Brewerton | 114/230.12 |
| 4,899,682 | A * | 2/1990 | Pouget et al. | 114/264 |
| 4,983,073 | A * | 1/1991 | Petty et al. | 405/224 |
| 5,823,130 | A | 10/1998 | Kreyn et al. | |
| 6,085,851 | A * | 7/2000 | Scott et al. | 175/7 |
| 6,199,500 | B1 * | 3/2001 | B.o slashed.rseth et al. | 114/230.12 |
| 6,378,450 | B1 * | 4/2002 | Begnaud et al. | 114/264 |
| 6,390,733 | B1 * | 5/2002 | Burbage et al. | 405/203 |

FOREIGN PATENT DOCUMENTS

| | | |
|---|---|---|
| BE | 840 225 A | 7/1976 |
| GB | 2 110 602 A | 6/1983 |

(Continued)

*Primary Examiner*—Jong-Suk (James) Lee
(74) *Attorney, Agent, or Firm*—The Webb Law Firm

(57) ABSTRACT

Disclosed is a vessel comprising at least two parallel hulls at a predetermined mutual distance. A deck structure is supported on the hulls. Fluid storage tanks are placed in the at least two hulls, at least partly below the deck structure. The deck structure carries fluid processing and/or production equipment. The fluid is a hydrocarbon. The ratio of length to width of the vessel being at least 3, preferably at least 4. The length of the vessel being at least 150 m, preferably at least 250 m, more preferably at least 350 m.

11 Claims, 3 Drawing Sheets

FOREIGN PATENT DOCUMENTS

| | | | |
|---|---|---|---|
| WO | 8808806 | * | 11/1988 |
| WO | WO 99 50527 A | | 10/1999 |
| WO | WO 0058597 A | | 10/2000 |

* cited by examiner

MULTI HULL BARGE

BACKGROUND OF THE INVENTION

1. Field of the Invention

The invention relates to a vessel comprising at least two parallel hulls at a predetermined mutual distance, a deck structure supported on said hulls and fluid storage tanks.

2. Description of the Related Art

From U.S. Pat. No. 3,943,872 an LNG carrier is known, having two parallel hulls interconnected by transverse beams on which cargo tanks are supported. The known LNG tanker has a high center of mass and thereby a reduced stability. Furthermore, the LNG tanks occupies the majority of available deck space.

BRIEF SUMMARY OF THE INVENTION

It is an object of the present invention to provide a vessel with large storage facilities for hydrocarbons, which can be built with standard shipbuilding facilities rather than under offshore standards.

It is a further object of the present invention to provide a barge of large dimension which is very stable and which can support a large number of different applications.

Thereto, the vessel according to the present invention is characterized in that the fluid storage tanks are placed in the at least two hulls, at least partly below the deck structure, the deck structure carrying fluid processing and/or production equipment, wherein the fluid is a hydrocarbon, the ratio of length to width of the vessel being at least 3, preferably at least 4, the length of the vessel being at least 150 m, preferably at least 250 m, more preferably at least 350 m.

By storing the fluid storage tanks in both hulls, a low center of gravity is obtained, such that the vessel stability is very large. Furthermore, in case the deck space extends over the storage tanks, this deck space can be used for supporting a variety of different equipment.

The storage tanks of the present invention contain hydrocarbons, the hydrocarbon processing equipment being situated on the deck structure.

The barge can have very large dimensions, for instance with a length to width ratio of at least 3, preferably at least 4. The width of each hull can be at least 25 m, preferably at least 35 m, whereas the distance between the hulls may be at least 15 m, preferably at least 20 m. The total vessel length may be over 150 m, preferably 350 m or more.

Preferably, the tanks comprise LNG storage tanks. The vessel can be used as a floating power plant wherein LNG is stored in the tanks in the hull of the vessel and a regasification plant combined with a gas fuelled power generation unit is situated on the deck structure. Alternatively, the power generation unit can be placed on shore. Furthermore, it is possible to have an oil fuelled power plant on deck of the vessel, the storage tanks containing oil. Other applications are use of the vessel as an FPSO where the large deck space is used for supporting process equipment, the oil being stored in the hull. Drilling or workover equipment can be supported on the deck structure, even as separation equipment, the oil being stored in the tanks in the hull. A Tension Leg Deck (TLD), wherein risers and a drill string are supported from a pivoting deck structure, such as described in International Publications WO 99/50527 and WO 00/58597, which are incorporated herein by reference, can be integrated in the design. The pivoting deck structure can be placed between the two hulls of the barge.

The present vessel provides a very stable platform, especially for LNG liquefaction, processing and storage.

The vessel provides a very good draught control for light LNG cargo by having a low point of gravity.

The construction of the vessel can be carried out by separately constructing the hulls under standard shipbuilding conditions, possibly in independent yards simultaneously. This results in a shorter building time where the LNG tanks can be integrated in the hull upon assembly.

Assembly of the hulls and connection of the deck structure can be carried out alongside the shipyard in sheltered waters, under favourable conditions at sea or in a dry-dock. The vessel according to the present invention can have a very large size beyond the maximum dock size available.

By using both hulls for storage, enhanced safety is obtained as an optimal separation of rows of product tanks is achieved.

The dynamic response of the barge under sea-going conditions will be reduced compared to single hull designs, whereas the vessel can be moored by a variety of moorings, such as an internal or external turret mooring, spread moorings, tension legs, etc.

The turret structure to which anchor lines extending from the seabed and/or product risers are connected may be situated at the bow of the vessel or between the hulls such that the vessel can rotatably weathervane around the turret. The advantage of turret mooring is that the turret need not be placed through a hull structure. In a regular vessel having a single hull and a turret extending through the hull, the tanks in the vicinity of the turret could not be allowed to be filled with LNG from a safety point of view. By the design of the present invention, wherein the turret is situated between the two hulls, the tanks in the hulls in the vicinity of the turret can be safely employed.

Preferably, the deck structure of the vessel is substantially closed, such that spills of hydrocarbons will not fall directly into the water. In case LNG is stored in the tanks, a closed deck avoids potentially dangerous situations created by LNG spills.

BRIEF DESCRIPTION OF THE DRAWINGS

Some embodiments of a vessel according to the present invention will be described in detail with reference to the accompanying drawing. In the drawings.

DETAILED DESCRIPTION OF THE INVENTION

Figure 1:
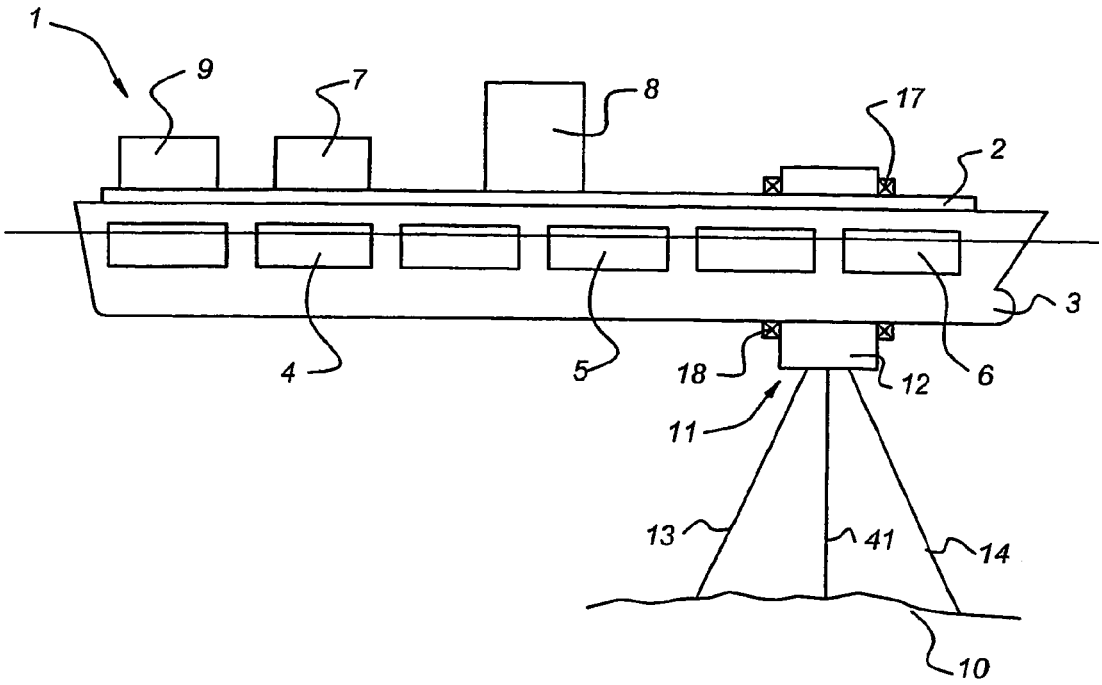
FIG. 1 shows a schematic side view of a vessel of the present invention.

FIG. 1 shows a vessel 1 in a side view having a deck structure 2 extending over two parallel hulls of which hull 3 is shown in FIG. 1. The hull 3 comprises a row of storage tanks 4, 5, 6. On the deck structure 2, processing equipment 7, 8 is placed as are personnel quarters 9. The vessel 1 is moored to the seabed 10 via a turret 11. The turret 11 comprises a stationary part 12 moored to the seabed 10 via anchor legs 13, 14 and product risers 41, connected to the deck structure 2 and to a lower part of the hull 3 via upper bearings 17 and lower bearings 18. It is also possible to replace anchor legs 13, 14 with a spread mooring construction such as shown in FIG. 2, in which anchor lines 22–25 are connected to the hulls or deck structure near the corners of the deck structure, or to use the anchor legs 13, 14 in combination with such a spread mooring configuration.

Figure 2:
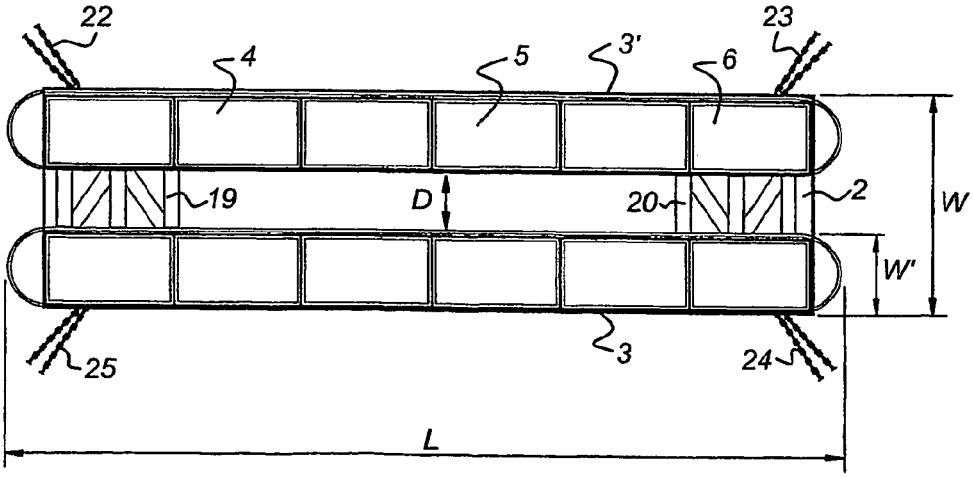
FIG. 2 shows a top view of the vessel according to FIG. 1.

FIG. 2 shows a top view of an alternative embodiment of the vessel of the present invention in which only the outline of the deck structure 2 has been drawn to show underlying storage tanks 4, 5, 6, connecting two parallel hulls 3, 3'. The hulls 3, 3' are connected via bracings 19, 20 near the bow and the stern of the vessel. The vessel is moored via a spread moored anchoring configuration with four sets of mooring lines 22, 23, 24, 25.

Figure 3:
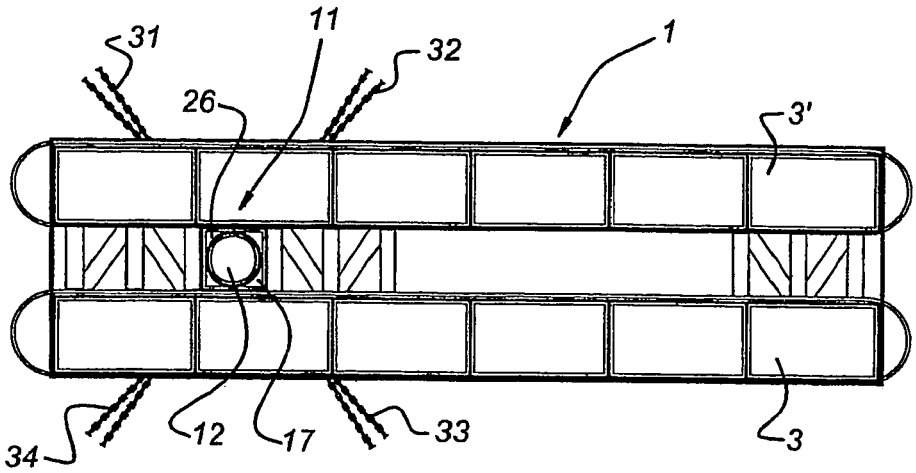
FIG. 3 shows an embodiment of a vessel having two parallel hulls and a turret situated between the hulls.

FIG. 3 shows an embodiment wherein the turret 11 can be seen to be situated between the two hulls 3, 3'. The stationary part 12 of the hull is connected via the bearings 17, 18 to upper en lower support rings 26 attached to the hulls 3, 3'. Four sets of mooring lines 31–34 may be attached to the hulls 3, 3' in the vicinity of the turret 11 for allowing weathervaning of the vessel 1 around the stationary part 12 of the turret through small angles.

Figure 4:
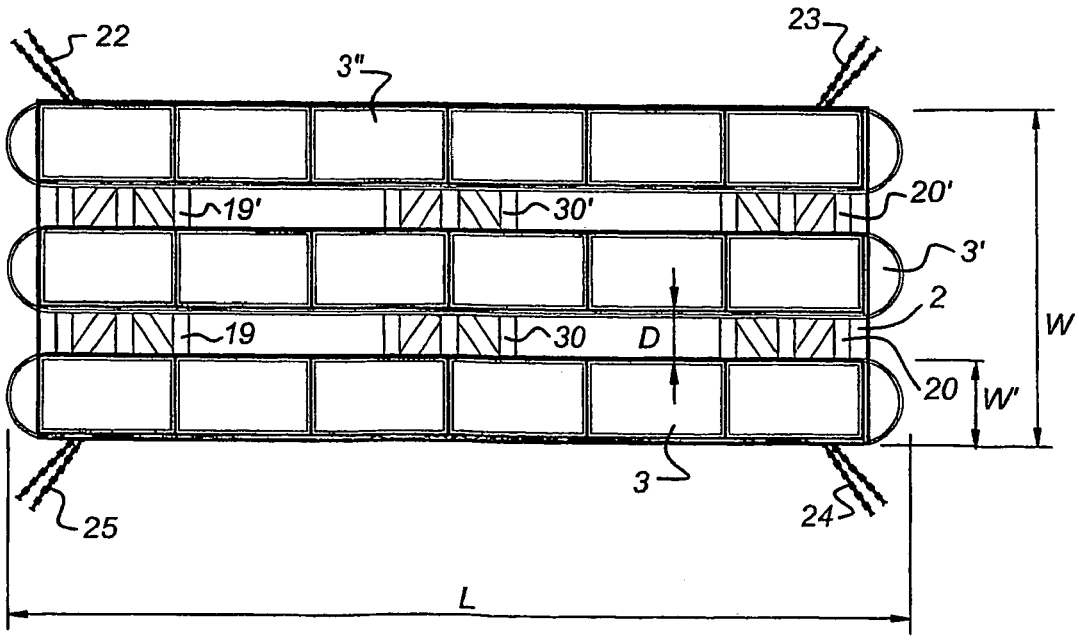
FIG. 4 shows an embodiment of the vessel having three parallel hulls.

FIG. 4 shows an embodiment using three parallel hulls 3, 3', 3" interconnected by bracing's 19, 19', 20, 20' at bow and stern and by central bracings 30, 30'. The hulls 3–3" can be built as standard tanker hulls with a width W' of for instance 35 m, a space D between the hulls of 20 m and a total length L of about 350 m. The hulls can be interconnected with the deck structure 2 when the hulls are placed within a dry-dock, or, whenever the total width W of the vessel (for instance 100 m or more) becomes too large for a dry-dock, alongside the shipyard. Interconnecting the hulls via the bracings 19, 20, 30, can be carried out in a deballasted condition of the two hulls above water level whereas the bracings will be partly below water or completely submerged in a ballasted condition. The shape of the storage tanks can be circular, rectangular, cylindrical or any other shape, but are preferably totally within the hulls such that the deck space of deck structure 2 can be completely used by hydrocarbon processing equipment 7, 8.

Figure 5:
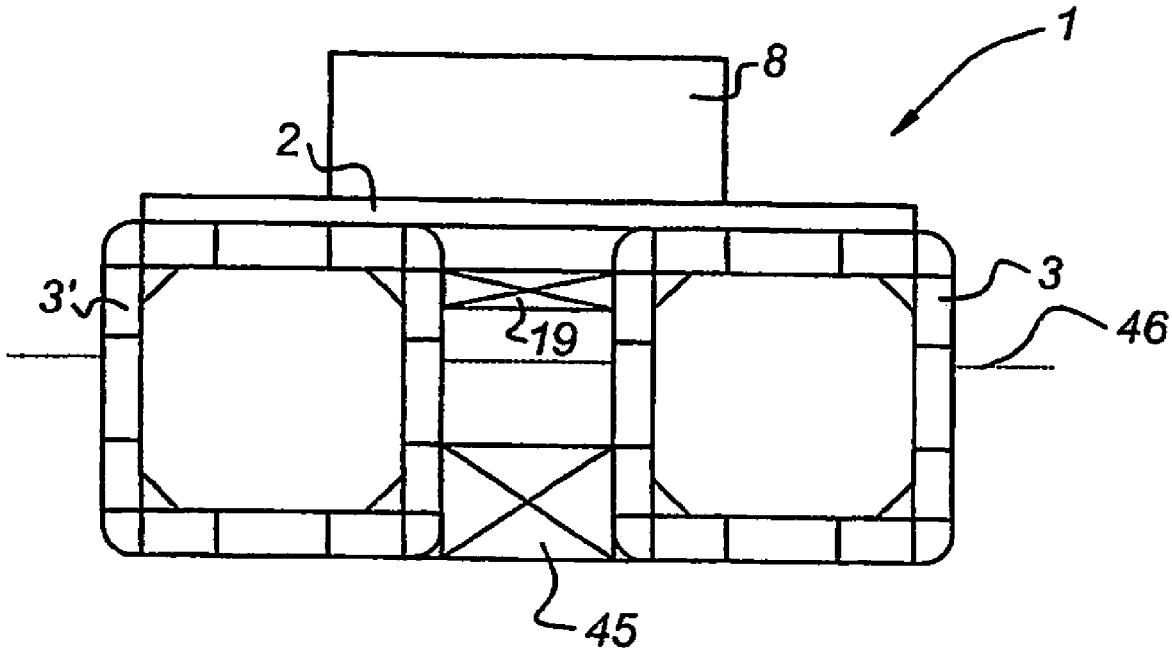
FIG. 5 shows a frontal view of the vessel according to FIG. 1.

Finally, FIG. 5 shows a frontal view of the vessel 1 of the present invention in which can be seen that the hulls 3, 3' are interconnected by an upper bracing 19, situated above water level 46 and a lower bracing 45. The lower bracing 45 can comprise an enclosed box type structure, shich provides added mass and serves as an dampener for pitch and heave motions of the vessel, thus increasing the vessels stavility.

The invention claimed is:

1. A vessel anchored to the seabed via anchor lines comprising:

at least two parallel hulls at a predetermined mutual distance, each hull in use extending above water level along an elongated water line, a deck structure supported on said hulls in the vicinity thereof, and LNG storage tanks, wherein the LNG storage tanks are placed in the at least two hulls, at least partly below the deck structure, a product riser extends between the vessel and the seabed for transport of hydrocarbons to the storage tanks, the deck structure carries cryogenic processing and/or production equipment comprising a regasification plant, being in fluid connection with the storage tanks, the ratio of length to width of the vessel is at least 3, a length of the vessel is at least 150 m, and a turret extending between the hulls, the turret comprising an annular support member and a central cylinder rotatably supported in the support member and connected with a lower part to the seabed via an elongate member, the LNG storage tanks in the vicinity of the turret being adapted to be filled with LNG.

2. The vessel according to claim 1, wherein a width of each hull is at least 25 m, and a distance between the hulls is at least 15 m.

3. The vessel according to claim 1, wherein no storage tanks are placed on the deck structure.

4. The vessel according to claim 1, wherein a power plant is placed on the deck structure.

5. The vessel according to claim 1, wherein the turret extends at a bow of the vessel.

6. The vessel according to claim 1, wherein the deck structure is substantially closed.

7. The vessel according to claim 1, wherein the hulls are interconnected via transverse beams near a bow and a stern.

8. The vessel according to claim 7, wherein the hulls are interconnected via transverse beams near mid-sections of the hulls.

9. The vessel according to claim 1, wherein the ratio of the length to the width of the vessel is at least 4.

10. The vessel according to claim 1, wherein the length of the vessel is at least 250 m.

11. The vessel according to claim 1, wherein the length of the vessel is at least 350 m.

* * * * *